US010283880B2

(12) United States Patent
Kettern

(10) Patent No.: US 10,283,880 B2
(45) Date of Patent: May 7, 2019

(54) TERMINAL CLAMP FOR CONNECTING AN ELECTRICAL CONDUCTOR

(71) Applicant: Phoenix Contact GmbH & Co. KG, Blomberg (DE)

(72) Inventor: Markus Kettern, Lemgo (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/752,257

(22) PCT Filed: Sep. 14, 2016

(86) PCT No.: PCT/EP2016/071642
§ 371 (c)(1),
(2) Date: Feb. 13, 2018

(87) PCT Pub. No.: WO2017/046129
PCT Pub. Date: Mar. 23, 2017

(65) Prior Publication Data

US 2018/0248276 A1 Aug. 30, 2018

(30) Foreign Application Priority Data

Sep. 16, 2015 (DE) ..... 10 2015 115 612

(51) Int. Cl.
*H01R 4/48* (2006.01)
*H01R 4/40* (2006.01)

(52) U.S. Cl.
CPC ..... *H01R 4/4836* (2013.01); *H01R 4/40* (2013.01); *H01R 4/4845* (2013.01)

(58) Field of Classification Search
CPC ..... H01R 4/4836; H01R 4/40; H01R 11/22
(Continued)

(56) References Cited

U.S. PATENT DOCUMENTS

D671,500 S * 11/2012 Kettern ..... D13/149
D671,897 S * 12/2012 Kettern ..... D13/149
(Continued)

FOREIGN PATENT DOCUMENTS

DE 102012110895 A1 5/2014
EP 2400595 A1 12/2011
EP 2835870 A2 2/2015

*Primary Examiner* — Abdullah Riyami
*Assistant Examiner* — Nader Alhawamdeh
(74) *Attorney, Agent, or Firm* — Leydig, Voit & Mayer, Ltd.

(57) ABSTRACT

A connection terminal for connecting an electrical conductor includes: an insulating housing having at least one conductor terminal device which in each case can be operated by an actuation element mounted in the insulating housing so as to be pivotable about a pin. The at least one conductor terminal device includes a clamping point for the electrical conductor that is formed by a contact element arranged in a stationary manner in the insulating housing and a clamping spring that is arranged in the insulating housing so as to be movable, by the actuation element, between an open position and a clamping position by a free leg of the clamping spring being articulated to the actuation element by a connecting element such that the clamping spring can be moved into the open position by a pivot movement of the actuation element in a first direction.

9 Claims, 8 Drawing Sheets

(58) Field of Classification Search
USPC ..... 439/835
See application file for complete search history.

(56) References Cited

U.S. PATENT DOCUMENTS

| | | | | |
|---|---|---|---|---|
| 8,475,191 | B2 * | 7/2013 | Schafmeister ..... | H01R 4/4836 439/266 |
| 9,240,650 | B2 * | 1/2016 | Wu ..... | H01R 4/48 |
| 2006/0063419 | A1 * | 3/2006 | Steinkemper ..... | H01R 4/4827 439/441 |
| 2010/0081316 | A1 * | 4/2010 | Eppe ..... | H01H 1/5844 439/441 |
| 2011/0086525 | A1 * | 4/2011 | Begemann ..... | H01R 12/57 439/83 |
| 2011/0318972 | A1 | 12/2011 | Koellmann | |

* cited by examiner

TERMINAL CLAMP FOR CONNECTING AN ELECTRICAL CONDUCTOR

CROSS-REFERENCE TO PRIOR APPLICATIONS

This application is a U.S. National Phase application under 35 U.S.C. § 371 of International Application No. PCT/EP2016/071642, filed on Sep. 14, 2016, and claims benefit to German Patent Application No. DE 10 2015 115 612.1, filed on Sep. 16, 2015. The International Application was published in German on Mar. 23, 2017 as WO 2017/046129 under PCT Article 21(2).

FIELD

The present invention relates to a connection terminal for connecting an electrical conductor, comprising an insulating housing having at least one conductor terminal device which can in each case be operated by means of an actuation element that is mounted in the insulating housing so as to be pivotable about a pin, the conductor terminal device comprising a clamping point for the electrical conductor that is formed by a contact element arranged in a stationary manner in the insulating housing and a clamping spring that is arranged in the insulating housing so as to be movable, by means of the actuation element, between an open position and a clamping position by means of a free leg of the clamping spring being hinged to the actuation element by means of a connecting element such that the clamping spring is moved into the open position by a pivot movement of the actuation element in a first direction under the application of a tractive force by the connecting element, and is moved into the clamping position by means of a pivot movement that opposes the first direction, the actuation element comprising a hinge element that is radially spaced apart from the axial center of said actuation element and is designed for hingedly mounting the connecting element.

BACKGROUND

A connection terminal of this kind is known from DE 10 2012 110 895 A1 for example. This known connection terminal comprises a housing having a conductor insertion opening, via which the electrical conductor can be inserted into the terminal housing. A busbar, as a contact element, and a rotatably mounted spring element that can be pivoted between an open position and a clamping position by means of a corresponding actuation element are arranged in the housing.

In the clamping position, the inserted electrical conductor is held and at the same time electrically contacted by the clamping point formed by the spring element and the busbar. In the open position, the electrical conductor is released from the spring element and can be removed from the conductor insertion opening without the use of force.

A disadvantage is that a user has to continuously exert a force on the actuation element in order to hold the clamping point in the open position. It is thus not possible, for example, to operate the known connection terminal one-handed, because an actuation force always needs to be applied in order to open the clamping point.

SUMMARY

In an embodiment, the present invention provides a connection terminal for connecting an electrical conductor, comprising: an insulating housing having at least one conductor terminal device which is in each case configured to be operated by an actuation element mounted in the insulating housing so as to be pivotable about a pin, wherein the at least one conductor terminal device comprising a clamping point for the electrical conductor that is formed by a contact element arranged in a stationary manner in the insulating housing and a clamping spring that is arranged in the insulating housing so as to be movable, by the actuation element, between an open position and a clamping position by a free leg of the clamping spring being articulated to the actuation element by a connecting element such that the clamping spring is configured to be moved into the open position by a pivot movement of the actuation element in a first direction and under application of a tractive force by the connecting element, and is configured to be moved into the clamping position by a pivot movement that opposes the first direction, wherein the actuation element comprises a hinge element that is radially spaced apart from an axial center of the actuation element and is configured for hingedly mounting the connecting element, and wherein the hinge element is arranged on the actuation element such that, in the open position, a lever arm formed by the hinge element and the axial center is at least substantially in parallel with a direction of the tractive force that acts on the free leg of the clamping spring via the connecting element.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 5 is a perspective view of a multi-connection terminal for mounting on a printed circuit board having a horizontal conductor lead-in, FIG. 6 shows the multi-connection terminal shown in FIG. 5 having a vertical conductor lead-in, FIG. 7 is a perspective view of a multi-connection terminal formed as a plug connector having a horizontal lead-in, and FIG. 8 shows the multi-connection terminal shown in FIG. 7 having a vertical conductor lead-in.

DETAILED DESCRIPTION

Figure 1:
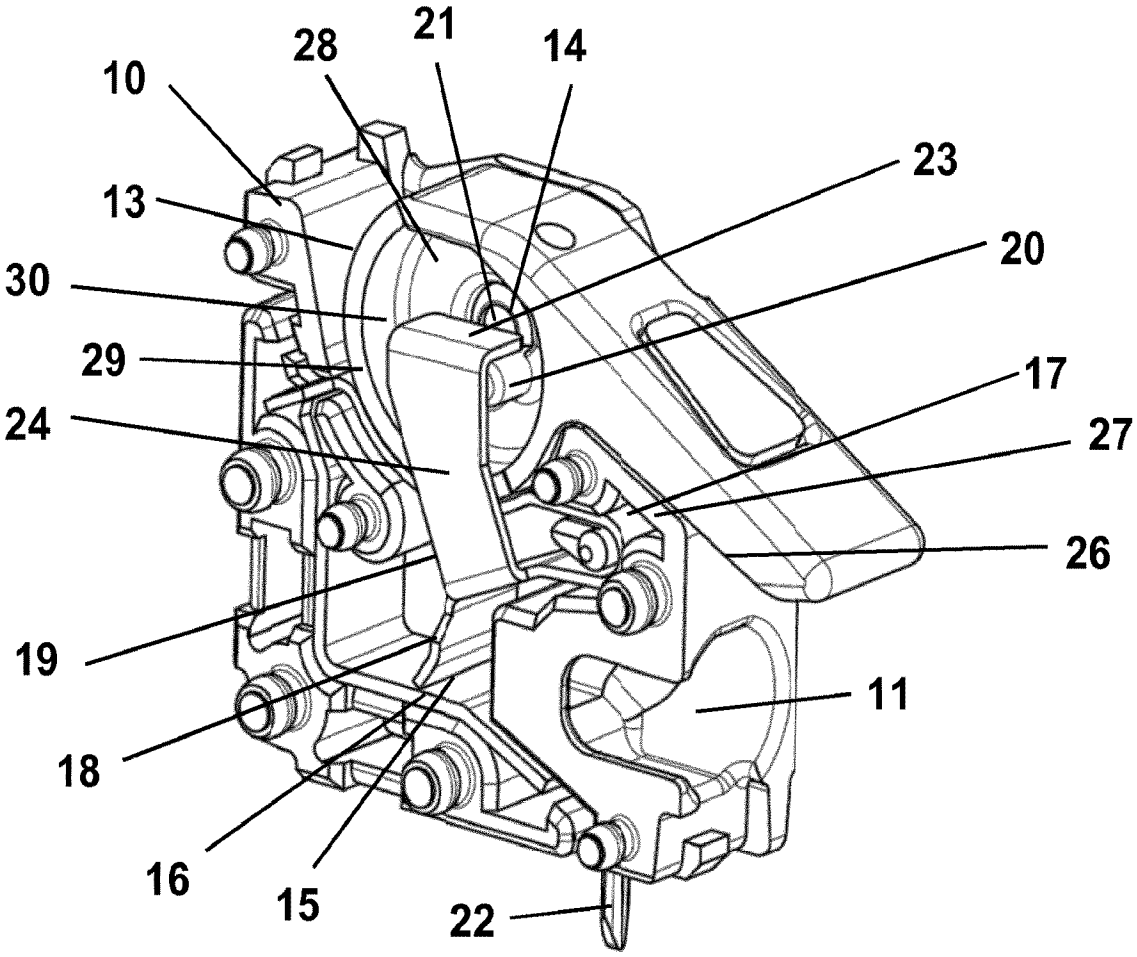
FIG. 1 is a perspective view of the connection terminal according to the invention in the clamping position and when the insulating housing is open.

In an embodiment, the present invention provides a connection terminal having the features mentioned at the outset, in that the hinge element is arranged on the actuation element such that the lever arm formed by the hinge element and the axial center is oriented, in the open position, at least substantially in parallel with the direction of the tractive force acting on the free leg of the clamping spring by means of the connecting element. The advantage of the above-mentioned orientation of the lever arm in the open position is that the actuation element reaches a torque-free or substantially torque-free state in the open position. In the open position, the tractive force of the clamping spring acts in the direction of or substantially in the direction of the lever arm, and therefore the torque acting on the actuation element is minimal. The actuation element thus automatically remains in the open position, provided said element has been moved once into the open position. The clamping point is also open in this state, and the electrical conductor can be inserted between the contact element and the free leg of the clamping spring without the need for retention forces to be exerted on the actuation element from the outside. In this way, the electrical conductor can be inserted into the connection terminal according to the invention in particular one-handed. In order to clamp the electrical conductor, the actuation element must be actively pivoted in a direction that is opposite to the first direction.

In other words, the connection terminal according to the invention is designed and formed so as to be bistable. When the open position is achieved by pivoting the actuation element, the conductor terminal device automatically remains in said open position until the actuation element is actively pivoted in the opposite direction in order to be moved back into the clamping position. The expression "at least substantially in parallel" is intended to mean in parallel or substantially in parallel, i.e. deviating from the parallel by a small angle, in particular by an angle of less than 10°.

A further advantage is that no forces act on the insulating housing from the conductor terminal device. The conductor terminal device is therefore formed such that the above-described tractive force of the clamping spring and the torques acting on the actuation element act only inside the conductor terminal device, while said device is largely free of force towards the outside.

An expedient embodiment of the invention is characterized in that the connecting element comprises a planar contact region that overlaps the hinge element such that the hinge element is movable relative to the contact region. In this way, the hinge element that is arranged eccentrically on the actuation element can move on the circular path portion specified by the eccentric arrangement. While a force component in the direction of the tractive force is directly transmitted from the hinge element to the connecting element, movements of the hinge element in the direction orthogonal thereto are not directly transmitted to the connecting element. The planar contact region is preferably formed by a chamfered region of the connecting element.

A preferred development of the invention is characterized in that the planar contact region is arranged so as to be at right angles to a connecting portion of the connecting element. In this way, as large as possible a bearing surface is obtained between the hinge element and the contact region of the connecting element. More preferably, the connecting portion and the contact region are formed integrally, for example by right-angled bending of a part of the connecting portion that thus forms the contact region.

According to a further preferred embodiment of the invention, the connecting portion is angled. This achieves compensation, at least in part, of the oblique positioning of the free leg of the clamping spring in relation to the housing base of the insulating housing, with the result that, in the clamping position, the contact region assumes a position that is in parallel with or at least substantially in parallel with the housing base. The connecting portion is preferably angled such that the mentioned oblique positioning of the free leg in the clamping position and when the electrical conductor is not inserted results in an orientation of the contact region that is in parallel with or substantially in parallel with the housing base.

A further expedient embodiment of the invention is characterized in that the actuation element comprises an operating lever designed for operating the conductor terminal device, the operating lever being designed such that the lower face thereof is in contact with a portion of the insulating housing above the clamping point when in the clamping position. This has the advantage that, in the clamping position, the operating lever is in close contact with the insulating housing and at the same time comprises a defined end stop.

According to a further preferred embodiment, the hinge element is arranged on the actuation element such that the hinge element is in any case positioned below the axial center, specifically between the axial center and the free leg of the clamping spring, when in the clamping position. The hinge element is therefore arranged on the actuation element below the axial center with respect to the housing base. This is advantageous in that the lever arm formed by the hinge element and the axial center is oriented in parallel or substantially in parallel with the direction of the tractive force in the clamping position too.

The torque acting on the actuation element via the hinge element is therefore minimal in the clamping position too. It should be noted that, in the case when an electrical conductor is inserted into the clamping point, the free leg of the clamping spring contacts the electrical conductor under the action of a spring force, and therefore the hinge element is already released from the connecting element or from the contact region thereof before the actuation element reaches the clamping position itself.

A further expedient embodiment of the invention is characterized in that the pivoting range of the actuation element between the clamping position and the open position is selected so as to be at least so large that the hinge element is in any case positioned above the axial center when in the clamping position. This advantageously minimizes the torque acting on the actuation element in the open position, which torque would otherwise cause automatic restoration to the clamping position. The mentioned arrangement ensures that the actuation element remains in the open position even without the action of outside forces. The pivoting range of the actuation element between the clamping position and the open position preferably comprises an angle of more than 90°.

According to a further preferred embodiment of the invention, the hinge element is designed so as to protrude at the end face. The geometry of the actuation element can thus be kept as simple as possible, since hinged mounting of the connecting element is made possible by a lateral arrangement and engagement with the protruding hinge element.

According to an advantageous development of the invention, the hinge element is formed as a double peg. Forming the hinge element as a double peg provides said element with greater mechanical stability. Moreover, the double peg provides a larger contact surface for contact with the contact region. In addition to an improved distribution of the acting tractive force, this also results in more stable behavior of the actuation element, in particular in the open position, and therefore, in the open position, the actuation element still remains in the open position or is automatically restored thereto even when the actuation element is slightly deflected towards the clamping position.

According to a preferred embodiment, the double pegs have the profile of a horizontal eight. The double pegs are therefore connected so as to merge into one another, and thus form an integral hinge element. The integrality achieves high mechanical stability of the hinge element.

Figure 3:
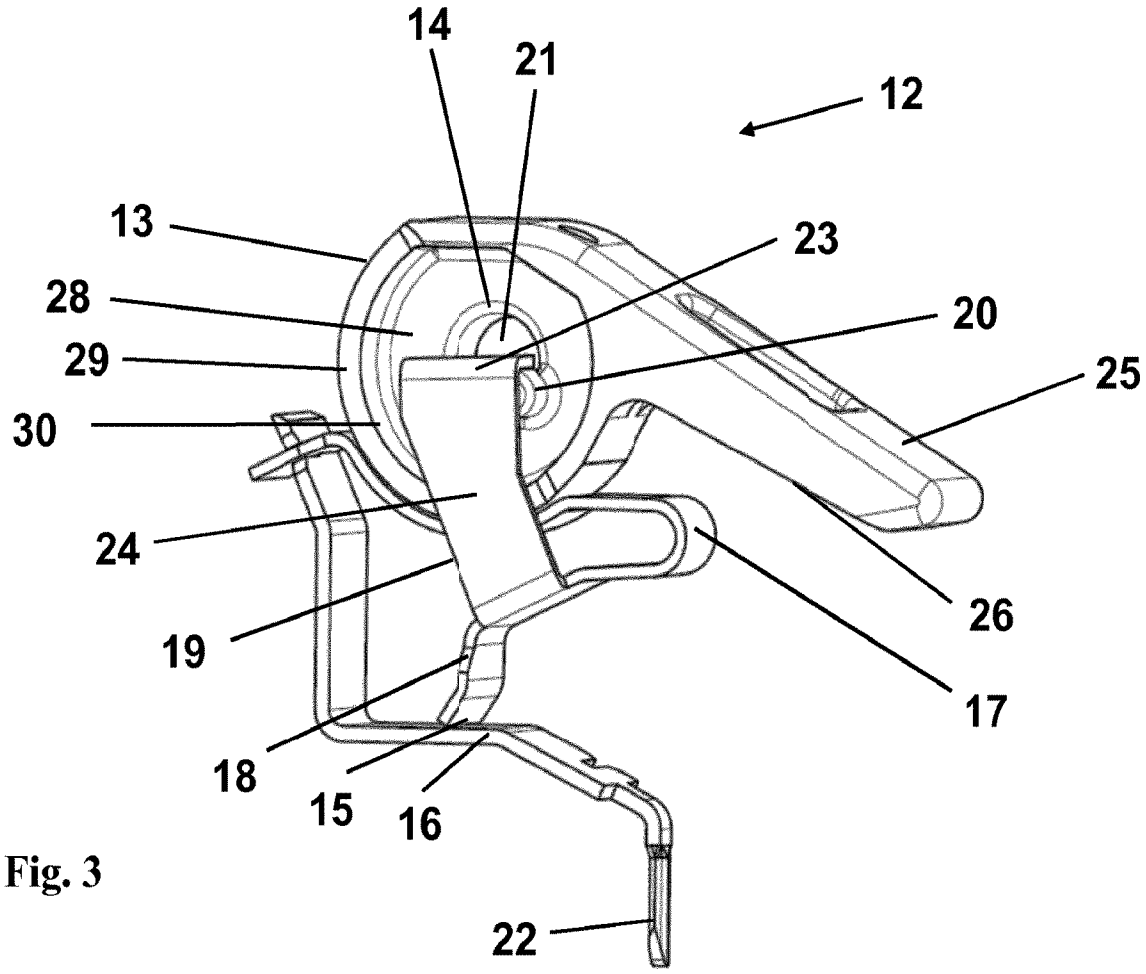
FIG. 3 is a perspective view of the conductor terminal device in the clamping position.

FIG. 1 is a perspective view of the connection terminal according to the invention in a clamping position and having an open insulating housing 10, in which clamping position an electrical conductor, inserted via a conductor guide 11, is electrically contacted and clamped under spring action by means of the conductor terminal device 12 shown in FIG. 3. The conductor terminal device 12 is designed and formed so as to be operable by means of an actuation element 13. For this purpose, the actuation element 13 is mounted in the insulating housing 10 so as to be pivotable about a pin. The actuation element 13 comprises a hole 14 for example, through which a shaft of the insulating housing 10 is guided, which shaft thus forms the above-mentioned pin.

Figure 2:
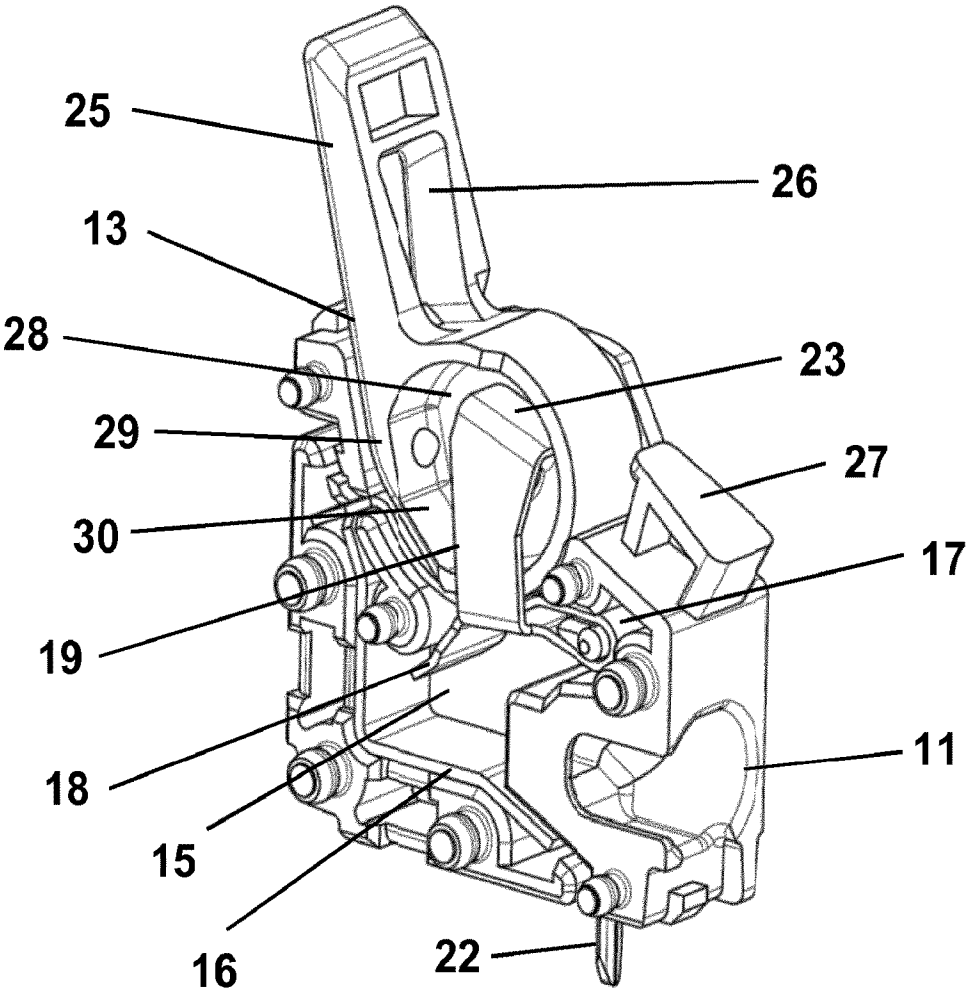
FIG. 2 shows the connection terminal shown in FIG. 1 in the open position.
Figure 4:
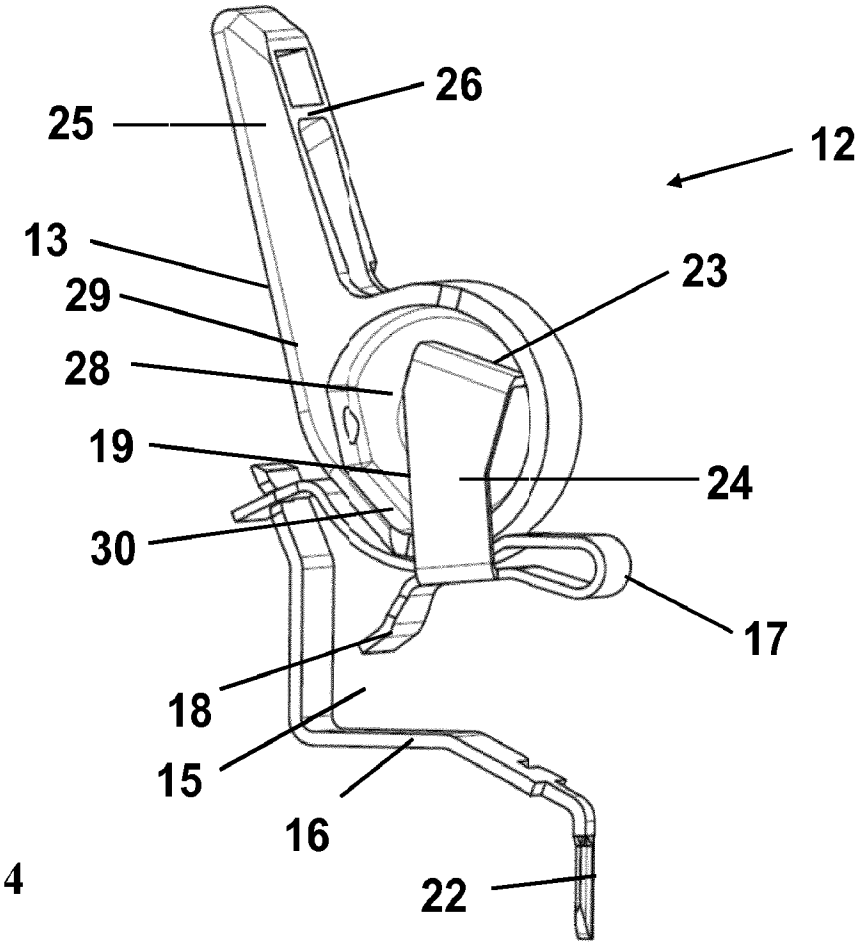
FIG. 4 is a perspective view of the conductor terminal device in the open position.

As can be seen from the perspective detail of the conductor terminal device 12 according to FIG. 3, the conductor terminal device 12 comprises a clamping point 15 for the electrical conductor. For this purpose, the clamping point 15 comprises a contact element 16 that is arranged in a stationary manner in the insulating housing 10. The contact element 16 and a clamping spring 17, which is spring preloaded and therefore automatically attempts to orient its free leg 17 towards the contact element 16, together form the clamping point 15. The clamping spring 17 is arranged in the insulating housing 10 such that it can be moved, by means of the actuation element 13, between the clamping position shown in FIGS. 1 and 3, and an open position shown in FIGS. 2 and 4, respectively.

As shown in FIGS. 1 to 4, the free leg 18 of the clamping spring 17 is hinged by means of a connecting element 19 such that the free leg 18 is arranged in the insulating housing 10 so as to be movable between the open position and the clamping position. A pivot movement of the actuation element 13 in a first direction moves the conductor terminal device 12 shown in FIGS. 1 and 3 from the clamping position and into the open position shown in FIGS. 2 and 4, a tractive force that acts counter to the restoring spring force being applied to the clamping spring 17 by the connecting element 19. In the embodiment shown by way of example in FIGS. 1 to 4, an anticlockwise pivot movement causes movement into the open position, while pivoting clockwise, i.e. in a direction opposed to the first direction, causes movement from the open position into the clamping position.

The actuation element 13 comprises a hinge element 20 that is designed for hingedly mounting the connecting element 19 and is radially spaced apart from the axial center 21 of said actuation element. In this case, the hinge element 20 is arranged on the actuation element 13 such that, in the open position, the lever arm formed by the hinge element 20 and the axial center 21 is at least substantially in parallel with the direction of the tractive force that acts on the free leg 18 of the clamping spring 17 via the connecting element 19. Within the meaning of the invention, the expression "at least substantially in parallel" means either parallel or virtually parallel, i.e. having a deviation from the parallel of at most ±10°. The lever arm denotes the distance between the hinge element 20 and the axial center.

If the actuation element is pivoted out of the clamping position in the first direction, the component of the tractive force acting at right angles to the lever arm brings about a restoring torque. The more the actuation element 13 approaches the open position, the more the lever arm is oriented in the direction of the tractive force, and therefore the restoring torque which acts on the actuation element 13 continuously decreases. When the open position is reached, the lever arm and the tractive force are oriented in the same direction or in approximately the same direction, and therefore the restoring torque is eliminated or is minimal. In this way, the actuation element 13 can be kept in the open position without the action of outside forces. An electrical conductor can thus be inserted into the connection terminal or the conductor lead-in 11 thereof in a particularly simple and comfortable manner, in particular one-handed.

The actuation element 13 is subsequently pivoted in the above-mentioned opposing direction. The contact element 16 is placed on the electrical conductor that is now clamped and at the same time electrically contacted against the contact element 16 on account of the restoring spring force of the clamping spring 17. At this point, the connecting element 19 is released from the hinge element 20 and can in principle be completely moved back into the original clamping position without the use of force.

The connection terminal shown in FIGS. 1 to 4 is designed as a printed circuit board connection terminal and comprises soldered connection pins 22 that are electrically conductively connected to the contact element 16. The contact element 16 and the soldered connection pins 22 are advantageously formed integrally. Instead of the soldered connection pins 22, other connection elements could be provided, for example known soldering contact elements which make it possible to mount the connection terminal on the printed circuit board surface, in particular by soldering.

The connecting element 19 preferably comprises a planar contact region 23. As can be seen in FIGS. 1 to 4, the contact region 23 overlaps the hinge element 20. The hinge element 20 is therefore movable relative to the contact region 23. The hinge element 20 can thus come into contact with the contact region 23 in order to transmit the tractive force and can transmit said force in the tractive force direction, but is free with regard to lateral movement.

Further preferably, the planar contact region 23 is arranged so as to be at right angles to a connecting portion 24 of the connecting element 19. In other words, the contact region 23 and the connecting portion 24 form an L-shaped profile. Particularly preferably, as shown in FIGS. 1 to 4, the entire connecting element 19 is formed as a clamp having a U-shaped profile.

Advantageously, the connecting portion 24 is angled. Particularly preferably, as shown in FIGS. 1 to 4, the connecting portion 24 is angled such that, in the clamping position and when no electrical conductor is inserted, the contact region 23 is oriented horizontally or in parallel with the housing base of the insulating housing.

The actuation element 13 particularly preferably comprises an operating lever 25 that is designed for operating the conductor terminal device 11, the lower face 26 of the operating lever 25 being in contact with a portion 27 of the insulating housing 10 above the clamping point 15 when in the clamping position.

Advantageously, the hinge element 20 is arranged on the actuation element 13 such that the hinge element 20 is in any case positioned below the axial center 21 when in the clamping position. The hinge element 20 is therefore positioned between the axial center 21 and the free leg 18 of the clamping spring 17.

More preferably, the pivoting range of the actuation element 13 between the clamping position and the open position is selected so as to be at least so large that the hinge element 20 is in any case positioned above the axial center 21 when in the clamping position. The pivoting range therefore at least comprises an angle of more than 90°.

The hinge element 20 is advantageously designed so as to protrude at the end face. More preferably, the end face 28 of the actuation element 13 is itself set back with respect to a lateral surface 29 of the actuation element. In other words, the actuation element advantageously comprises a circular recess 30, and therefore the end face 28 is offset toward the rear with respect to the lateral surface 29. In this case, the height of the hinge element 20, proceeding from the end face, is in particular selected to be at most so high that the lateral face 29 does not project therebeyond out of the recess 30.

The hinge element 20 is preferably formed as double pegs which can each be formed separately or integrally. In the case of an integral design, the double pegs preferably have the profile of a horizontal eight. The double pegs increase the overall stability and the double pegs also bring about improved latching of the actuation element 13 in the open position.

Figure 5:
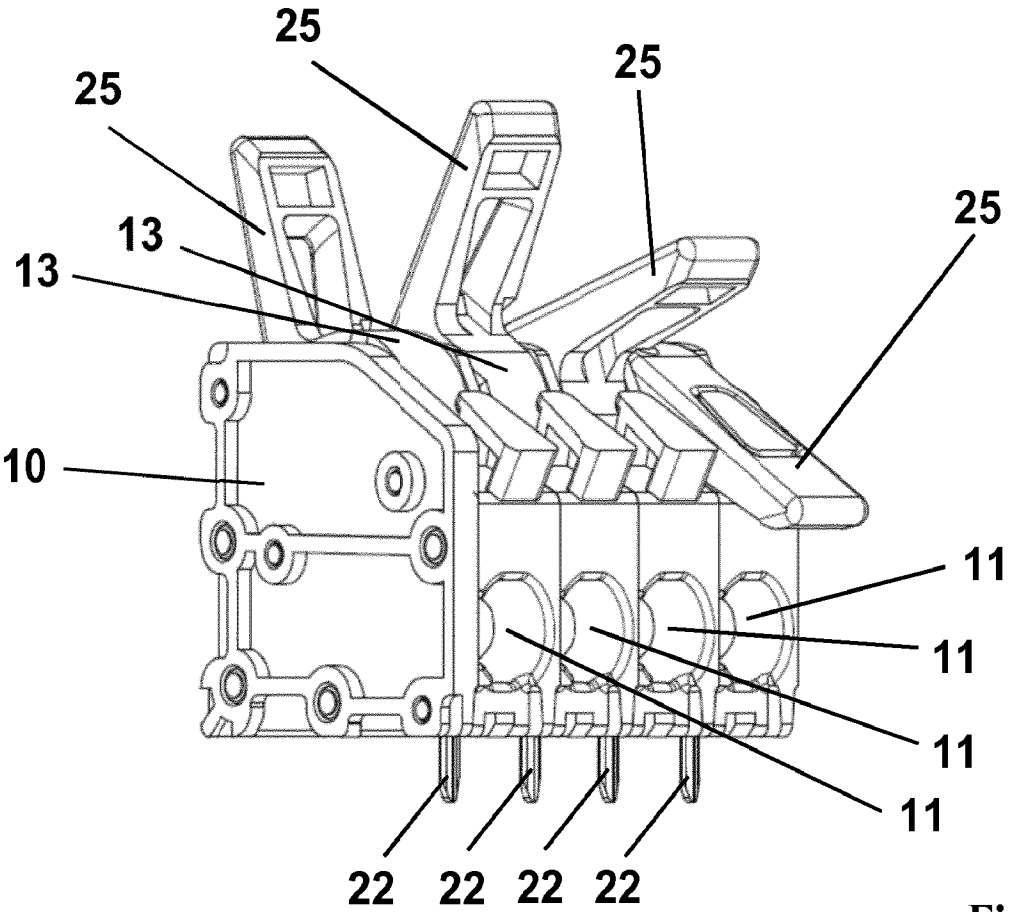
Figure 6:
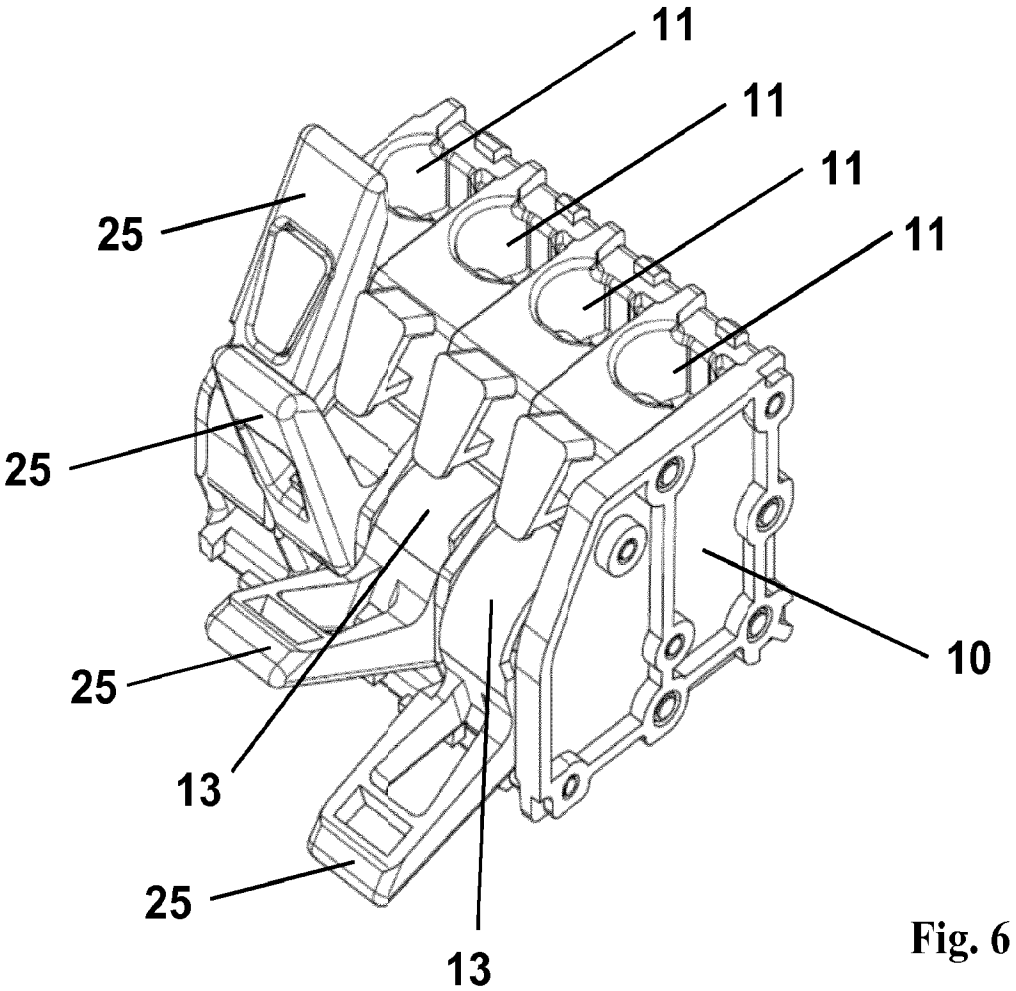

FIGS. 5 and 6 show a further advantageous embodiment of the invention. While FIG. 5 is a perspective view of a multi-connection terminal for mounting on a printed circuit board having horizontal conductor lead-ins 11, FIG. 6 shows a multi-connection terminal having vertical conductor lead-ins 11. The structure of the multi-connection terminals shown corresponds in principle to the connection terminal according to the invention that is described above and explained with reference to FIGS. 1 to 4, the difference being that a plurality of the conductor terminal devices 12 is in each case arranged in the insulating housing.

Figure 7:
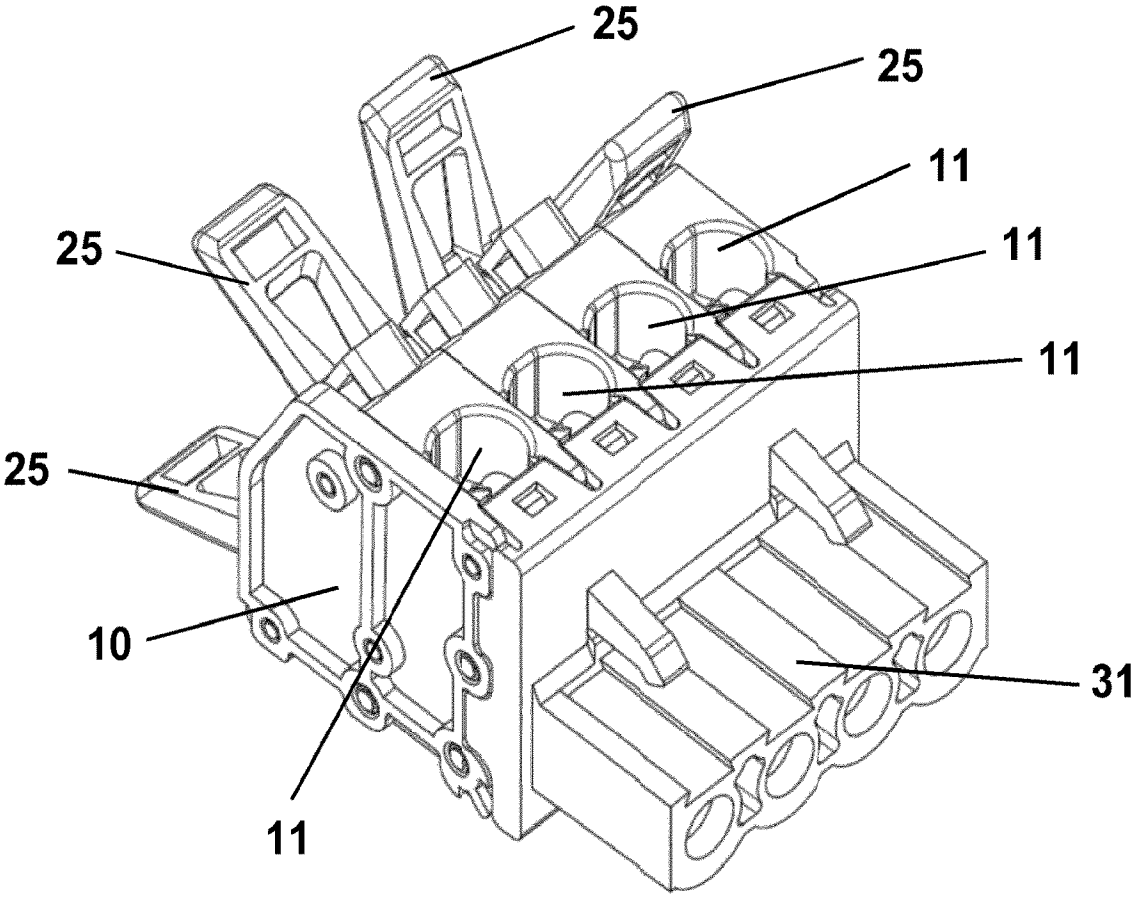
Figure 8:
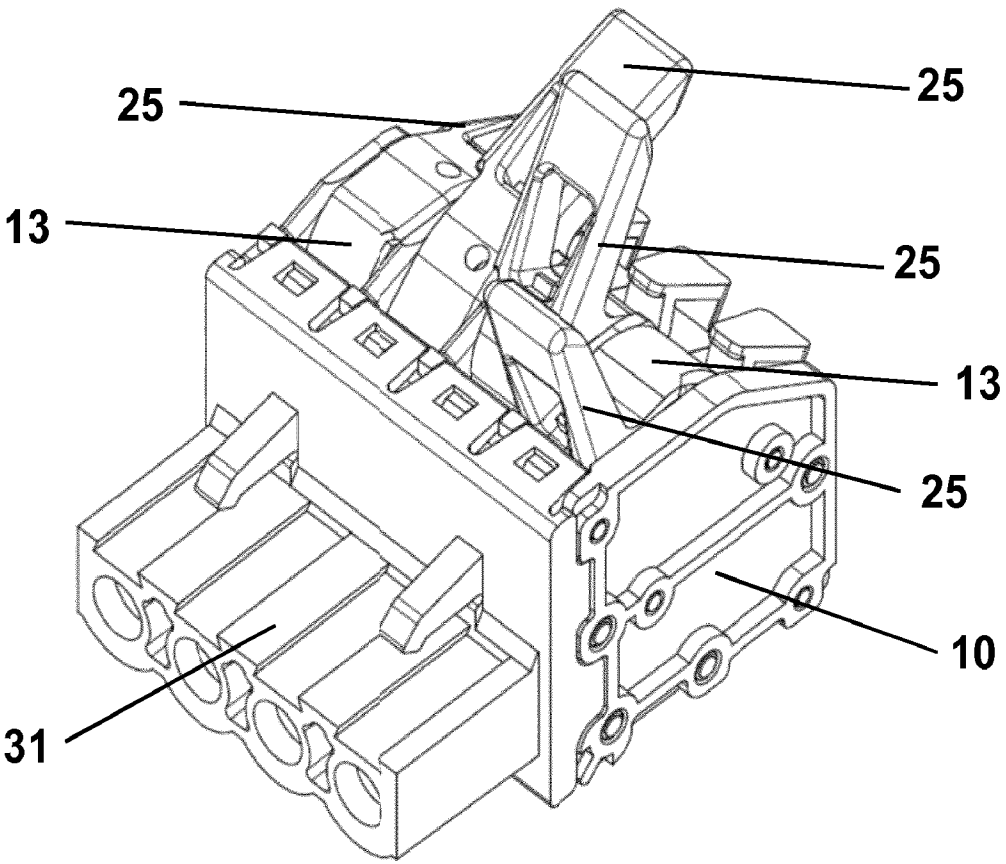

According to a further embodiment, the connection terminals are formed as plug connectors. FIG. 7 is a perspective view of a connector plug of this kind. The connector plug is preferably formed as a multi-connection terminal and in each case has horizontal conductor lead-ins 11. Alternatively, as shown in FIG. 8, the multi-connector plug shown is formed as a multi-connection terminal having vertical conductor lead-ins 11. The contact elements 16 are in each case formed as plug contact elements 31. In order to avoid repetition, regarding the conductor terminal devices 12, reference is made to the above explanations.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

10 insulating housing
11 conductor lead-in
12 conductor terminal device
13 actuation element
14 hole
15 clamping point
16 contact element
17 clamping spring
18 free leg
19 connecting element
20 hinge element
21 axial center
22 soldered connection pin
23 contact region
24 connecting portion
25 operating lever
26 lower face of the operating lever
27 portion
28 end face
29 lateral surface
30 recess (circular)
31 plug contact element

The invention claimed is:

1. A connection terminal for connecting an electrical conductor, comprising:

an insulating housing having at least one conductor terminal device which is in each case configured to be operated by an actuation element mounted in the insulating housing so as to be pivotable about a pin, wherein the at least one conductor terminal device comprising a clamping point for the electrical conductor that is formed by a contact element arranged in a stationary manner in the insulating housing and a clamping spring that is arranged in the insulating housing so as to be movable, by the actuation element, between an open position and a clamping position by a free leg of the clamping spring being articulated to the actuation element by a connecting element such that the clamping spring is configured to be moved into the open position by a pivot movement of the actuation element in a first direction and under application of a tractive force by the connecting element, and is configured to be moved into the clamping position by a pivot movement that opposes the first direction, wherein the actuation element comprises a hinge element that is radially spaced apart from an axial center of the actuation element and is configured for hingedly mounting the connecting element, wherein the hinge element is arranged on the actuation element such that, in the open position, a lever arm formed by the hinge element and the axial center is at least substantially in parallel with a direction of the tractive force that acts on the free leg of the clamping spring via the connecting element, wherein the connecting element comprises a planar contact region that overlaps the hinge element such that the hinge element is movable relative to the contact region, and wherein the planar contact region is arranged so as to be at right angles to a connecting portion of the connecting element.

2. The connection terminal according to claim 1, wherein the connecting portion is angled.

3. The connection terminal according to claim 1, wherein the actuation element comprises an operating lever configured for operating the at least one conductor terminal device, the operating lever being configured such that a lower face thereof is in contact with a portion of the insulating housing above the clamping point when in the clamping position.

4. The connection terminal according to claim 1, wherein the hinge element is arranged on the actuation element such that the hinge element is positioned below the axial center when in the clamping position.

5. The connection terminal according to claim 4, wherein a pivoting range of the actuation element between the clamping position and the open position is at least so large that the hinge element is positioned above the axial center when in the clamping position.

6. The connection terminal according to claim 1, wherein the hinge element protrudes at an end face.

7. The connection terminal according to claim 6, wherein the hinge element comprises a double peg.

8. The connection terminal according to claim 7, wherein the double peg has a profile in the shape of a horizontal eight.

9. The connection terminal according to claim 4, wherein the hinge element is positioned between the axial center and the free leg of the clamping spring when in the clamping position.

* * * * *